US010475385B2

(12) United States Patent
Xu

(10) Patent No.: US 10,475,385 B2
(45) Date of Patent: Nov. 12, 2019

(54) AMOLED PIXEL DRIVING CIRCUIT AND DRIVING METHOD CAPABLE OF ENSURING UNIFORM BRIGHTNESS OF THE ORGANIC LIGHT EMITTING DIODE AND IMPROVING THE DISPLAY EFFECT OF THE PICTURES

(71) Applicant: SHENZHEN CHINA STAR OPTOELECTRONICS TECHNOLOGY CO., LTD., Shenzhen, Guangdong (CN)

(72) Inventor: Xiangyang Xu, Guangdong (CN)

(73) Assignee: SHENZHEN CHINA STAR OPTOELECTRONICS TECHNOLOGY CO., LTD., Shenzhen, Guangdong (CN)

( * ) Notice: Subject to any disclaimer, the term of this patent is extended or adjusted under 35 U.S.C. 154(b) by 0 days.

(21) Appl. No.: 15/764,748

(22) PCT Filed: Mar. 9, 2018

(86) PCT No.: PCT/CN2018/078633

§ 371 (c)(1),
(2) Date: Mar. 29, 2018

(87) PCT Pub. No.: WO2019/165650

PCT Pub. Date: Sep. 6, 2019

(65) Prior Publication Data

US 2019/0266950 A1 Aug. 29, 2019

(30) Foreign Application Priority Data

Feb. 28, 2018 (CN) ..... 2018 1 0167440

(51) Int. Cl.
*G09G 3/3258* (2016.01)

(52) U.S. Cl.
CPC ... *G09G 3/3258* (2013.01); *G09G 2300/0819* (2013.01); *G09G 2320/0233* (2013.01); *G09G 2320/045* (2013.01)

(58) Field of Classification Search
CPC ..... G09G 3/3258; G09G 2320/045; G09G 2300/0819; G09G 2320/0233
See application file for complete search history.

(56) References Cited

U.S. PATENT DOCUMENTS

2005/0068271 A1* 3/2005 Lo ..... G09G 3/3233 345/76
2005/0285825 A1* 12/2005 Eom ..... G09G 3/3233 345/76

(Continued)

FOREIGN PATENT DOCUMENTS

CN 203858845 U 10/2014
CN 104361857 A 2/2015

(Continued)

*Primary Examiner* — Premal R Patel
(74) *Attorney, Agent, or Firm* — Leong C. Lei

(57) ABSTRACT

An AMOLED pixel driving circuit includes: first to third thin film transistors, a capacitor and an organic light emitting diode; a gate of the first thin film transistor receives a first scan signal, a source receives a data signal, and a drain is coupled to a first end of the capacitor; a gate of the second thin film transistor receives a second scan control signal, and a source is coupled to a second end of the capacitor, and a drain is coupled to an anode of the organic light emitting diode; a gate of the third thin film transistor is coupled to the second end of the capacitor, a source receives a first power source signal, and a drain is coupled to the anode of the organic light emitting diode; a cathode of the organic light emitting diode receives a second power source signal.

9 Claims, 3 Drawing Sheets

(56) References Cited

U.S. PATENT DOCUMENTS

| | | | | |
|---|---|---|---|---|
| 2011/0084947 | A1* | 4/2011 | Chung | G09G 3/3233 345/211 |
| 2011/0227885 | A1* | 9/2011 | Chung | G09G 3/3241 345/204 |
| 2013/0043796 | A1* | 2/2013 | Ko | G09G 3/3233 315/151 |
| 2015/0109277 | A1* | 4/2015 | Tseng | G09G 3/3233 345/211 |
| 2016/0247449 | A1* | 8/2016 | Yin | G09G 3/3233 |
| 2016/0343298 | A1* | 11/2016 | Xu | G09G 3/3233 |
| 2016/0365030 | A1* | 12/2016 | Wu | G09G 3/3258 |
| 2018/0301093 | A1* | 10/2018 | Li | G09G 3/3233 |

FOREIGN PATENT DOCUMENTS

| | | | |
|---|---|---|---|
| CN | 104658482 | A | 5/2015 |
| CN | 105679244 | A | 6/2016 |
| CN | 107093405 | A | 8/2017 |
| KR | 10-2012-0041425 | A | 5/2012 |

* cited by examiner

AMOLED PIXEL DRIVING CIRCUIT AND DRIVING METHOD CAPABLE OF ENSURING UNIFORM BRIGHTNESS OF THE ORGANIC LIGHT EMITTING DIODE AND IMPROVING THE DISPLAY EFFECT OF THE PICTURES

RELATED APPLICATIONS

The present application is a National Phase of International Application Number PCT/CN2018/078633, filed Mar. 9, 2018, and claims the priority of China Application No. 201810167440.4, filed Feb. 28, 2018.

FIELD OF THE INVENTION

The present invention relates to a display technology field, and more particularly to an active matrix organic light emitting diode pixel driving circuit and a driving method.

BACKGROUND OF THE INVENTION

The Organic Light Emitting Display (OLED) possesses many outstanding properties of self-illumination, low driving voltage, high luminescence efficiency, short response time, high clarity and contrast, near 180° view angle, wide range of working temperature, applicability of flexible display and large scale full color display. The OLED is considered as the most potential display device.

The OLED can be categorized into two major types according to the driving methods, which are the Passive Matrix OLED (PMOLED) and the Active Matrix OLED (AMOLED), i.e. two types of the direct addressing and the Thin Film Transistor (TFT) matrix addressing. The AMOLED comprises pixels arranged in array and belongs to active display type, which has high lighting efficiency and is generally utilized for the large scale display devices of high resolution.

The AMOLED is a current driving element. When the electrical current flows through the organic light emitting diode, the organic light emitting diode emits light, and the brightness is determined according to the current flowing through the organic light emitting diode itself. Most of the present Integrated Circuits (IC) only transmit voltage signals. Therefore, the AMOLED pixel driving circuit needs to accomplish the task of converting the voltage signals into the current signals. The traditional AMOLED pixel driving circuit generally is 2T1C, which is a structure comprising two thin film transistors and one capacitor to convert the voltage into the current.

A 2T1C pixel driving circuit traditionally employed for AMOLED, comprises a first thin film transistor, a second thin film transistor and a capacitor. The first thin film transistor is a switch thin film transistor, and the second thin film transistor is a drive thin film transistor, and the capacitor is a storage capacitor. Specifically, a gate of the first thin film transistor is electrically coupled to a scan signal, a source is electrically coupled to a data signal, a drain is electrically coupled to a gate of the second thin film transistor and one end of the capacitor; a drain of the second thin film transistor is electrically coupled to a power source positive voltage, and a source is electrically coupled to an anode of the organic light emitting diode; a cathode of the organic light emitting diode is electrically coupled to a power source negative voltage; the one end of the capacitor is electrically coupled to the drain of the first thin film transistor and the gate of the second thin film transistor, and the other end of the capacitor is electrically coupled to the source of the second thin film transistor and the power source negative voltage. When the AMOLED shows images, the scan signal controls the first thin film transistor to be activated, the data signal enters into the gate of the second thin film transistor and the capacitor, and then the first thin film transistor is deactivated. Due to the storage function of the capacitor, the gate voltage of the second thin film transistor can still maintain the data signal voltage so that the second thin film transistor is in the activated state. The driving current enters the organic light emitting diode through the second thin film transistor to drive the organic light emitting diode to emit light.

The 2T1C pixel driving circuit traditionally employed for the AMOLED is highly sensitive to the threshold voltage of the thin film transistor, the channel mobility, the trigger voltage and the quantum efficiency of the organic light emitting diode and the transient of the power supply. The threshold voltage of the second thin film transistor, i.e. the drive thin film transistor (particularly as the driving thin film transistor is a low temperature polysilicon thin film transistor) will drift along with the working times. Thus, it results in that the luminescence of the organic light emitting diode D is unstable; furthermore, the drifts of the second thin film transistors of the respective pixels, i.e. the drive thin film transistors are different, of which the drift values may be increasing or decreasing to cause the nonuniform luminescence and uneven brightness among the respective pixels. The traditional 2T1C pixel driving circuit without compensation can causes 50% nonuniform brightness or even higher.

One method to solve the nonuniform AMOLED display brightness is to add a compensation circuit to each of the pixels. The compensation means that the compensation has to be implemented to the parameters of the drive thin film transistor, such as threshold voltage or mobility to each of the pixels to make the current flowing through the organic light emitting diode irrelevant with these parameters.

SUMMARY OF THE INVENTION

An objective of the present invention is to provide an AMOLED pixel driving circuit, which can effectively compensate the threshold voltage of the drive thin film transistor and stabilize the current flowing through the organic light emitting diode to ensure the uniform brightness of the organic light emitting diode and improve the display effect of the pictures.

Another objective of the present invention is to provide an AMOLED pixel driving method, which can effectively compensate the threshold voltage of the drive thin film transistor and solve the issue of the unstable current flowing through the organic light emitting diode caused by the threshold voltage drift to achieve the uniform brightness of the organic light emitting diode and improve the display effect of the pictures.

For realizing the aforesaid objectives, the present invention provides an AMOLED pixel driving circuit, comprising: a first thin film transistor, a second thin film transistor, a third thin film transistor, a capacitor and an organic light emitting diode;

wherein a gate of the first thin film transistor receives a first scan signal, a source receives a data signal, and a drain is electrically coupled to a first end of the capacitor;

a gate of the second thin film transistor receives a second scan control signal, and a source is electrically coupled to a second end of the capacitor, and a drain is electrically coupled to an anode of the organic light emitting diode;

a gate of the third thin film transistor is electrically coupled to the second end of the capacitor, a source receives a first power source signal, and a drain is electrically coupled to the anode of the organic light emitting diode;

a cathode of the organic light emitting diode receives a second power source signal.

The first scan signal, the second scan signal, the first power source signal, and the data signal combine with one another to successively correspond to an initialization stage, a threshold voltage compensation stage, a charging stage, and a light emitting stage.

In the initialization stage, the first scan signal is at a low voltage level, the second scan signal is at a low voltage level, the first power source signal is a second power source voltage level, and the data signal is a first reference voltage level;

in the threshold voltage compensation stage, the first scan signal is at the low voltage level, the second scan signal is at the low voltage level, the first power source signal is the second power source voltage level, and the data signal is a second reference voltage level;

in the charging stage, the first scan signal is at the low voltage level, the second scan signal is at a high voltage level, the first power source signal is the second power source voltage level, and the data signal is a data signal voltage level;

in the light emitting stage, the first scan signal is at the high voltage level, the second scan signal is at the high voltage level, the first power source signal is a first power source voltage level, and the data signal is the first reference voltage level.

The first thin film transistor, the second thin film transistor and the third thin film transistor are all P type third thin film transistors.

The first reference voltage level is larger than the second reference voltage level, the second reference voltage level is larger than the data signal voltage level, and the first power source voltage level is larger than the second power source voltage level.

The first thin film transistor, the second thin film transistor and the third thin film transistor are all low temperature polysilicon thin film transistors.

The present invention further provides an AMOLED pixel driving method, comprising steps of:

Step S1, providing an active matrix organic light emitting diode pixel driving circuit, which comprises: a first thin film transistor, a second thin film transistor, a third thin film transistor, a capacitor and an organic light emitting diode;

wherein a gate of the first thin film transistor receives a first scan signal, a source receives a data signal, and a drain is electrically coupled to a first end of the capacitor;

a gate of the second thin film transistor receives a second scan control signal, and a source is electrically coupled to a second end of the capacitor, and a drain is electrically coupled to an anode of the organic light emitting diode;

a gate of the third thin film transistor is electrically coupled to the second end of the capacitor, a source receives a first power source signal, and a drain is electrically coupled to the anode of the organic light emitting diode;

a cathode of the organic light emitting diode receives a second power source signal;

Step S2, entering the initialization stage, the first scan signal providing a low voltage level, the second scan signal providing a low voltage level, the first power source signal providing a second power source voltage level, and the data signal providing a first reference voltage level;

Step S3, entering the threshold voltage compensation stage, the first scan signal providing the low voltage level, the second scan signal providing the low voltage level, the first power source signal providing the second power source voltage level, and the data signal providing a second reference voltage level;

Step S4, entering the charging stage, the first scan signal providing the low voltage level, the second scan signal providing a high voltage level, the first power source signal providing the second power source voltage level, and the data signal providing a data signal voltage level;

Step S5, entering the light emitting stage, the first scan signal providing the high voltage level, the second scan signal providing the high voltage level, the first power source signal providing a first power source voltage level, and the data signal providing the first reference voltage level.

The first thin film transistor, the second thin film transistor and the third thin film transistor are all P type third thin film transistors.

The first reference voltage level is larger than the second reference voltage level, the second reference voltage level is larger than the data signal voltage level, and the first power source voltage level is larger than the second power source voltage level.

The first thin film transistor, the second thin film transistor and the third thin film transistor are all low temperature polysilicon thin film transistors.

The present invention further provides an active matrix organic light emitting diode pixel driving circuit, comprising: a first thin film transistor, a second thin film transistor, a third thin film transistor, a capacitor and an organic light emitting diode;

wherein a gate of the first thin film transistor receives a first scan signal, a source receives a data signal, and a drain is electrically coupled to a first end of the capacitor;

a gate of the second thin film transistor receives a second scan control signal, and a source is electrically coupled to a second end of the capacitor, and a drain is electrically coupled to an anode of the organic light emitting diode;

a gate of the third thin film transistor is electrically coupled to the second end of the capacitor, a source receives a first power source signal, and a drain is electrically coupled to the anode of the organic light emitting diode;

a cathode of the organic light emitting diode receives a second power source signal;

wherein the first scan signal, the second scan signal, the first power source signal, and the data signal combine with one another to successively correspond to an initialization stage, a threshold voltage compensation stage, a charging stage, and a light emitting stage;

wherein in the initialization stage, the first scan signal is at a low voltage level, the second scan signal is at a low voltage level, the first power source signal is a second power source voltage level, and the data signal is a first reference voltage level;

in the threshold voltage compensation stage, the first scan signal is at the low voltage level, the second scan signal is at the low voltage level, the first power source signal is the second power source voltage level, and the data signal is a second reference voltage level;

in the charging stage, the first scan signal is at the low voltage level, the second scan signal is at a high voltage level, the first power source signal is the second power source voltage level, and the data signal is a data signal voltage level;

in the light emitting stage, the first scan signal is at the high voltage level, the second scan signal is at the high voltage level, the first power source signal is a first power source voltage level, and the data signal is the first reference voltage level;

wherein the first reference voltage level is larger than the second reference voltage level, the second reference voltage level is larger than the data signal voltage level, and the first power source voltage level is larger than the second power source voltage level;

wherein the first thin film transistor, the second thin film transistor and the third thin film transistor are all low temperature polysilicon thin film transistors.

The benefits of the present invention are: the present invention provides an AMOLED pixel driving circuit, comprising: a first thin film transistor, a second thin film transistor, a third thin film transistor, a capacitor and an organic light emitting diode; wherein a gate of the first thin film transistor receives a first scan signal, a source receives a data signal, and a drain is electrically coupled to a first end of the capacitor; a gate of the second thin film transistor receives a second scan control signal, and a source is electrically coupled to a second end of the capacitor, and a drain is electrically coupled to an anode of the organic light emitting diode; a gate of the third thin film transistor is electrically coupled to the second end of the capacitor, a source receives a first power source signal, and a drain is electrically coupled to the anode of the organic light emitting diode; a cathode of the organic light emitting diode receives a second power source signal; the present application can effectively compensate the threshold voltage of the drive thin film transistor to ensure the uniform brightness of the organic light emitting diode for providing the AMOLED pixel drive circuit work stability to improve the display effect of the pictures. The present invention further provides an active matrix organic light emitting diode pixel driving method capable of effectively compensating the threshold voltage of the driving thin film transistor, ensuring the uniform light emitting luminance of the organic light emitting diode, improving the working stability of the AMOLED pixel driving circuit, and improving the display effect of the image.

BRIEF DESCRIPTION OF THE DRAWINGS

In order to better understand the characteristics and technical aspect of the invention, please refer to the following detailed description and accompanying drawings of the present invention. However, the drawings are provided for reference only and are not intended to be limiting of the invention.

In drawings.

DETAILED DESCRIPTION OF PREFERRED EMBODIMENTS

For better explaining the technical solution and the effect of the present invention, the present invention will be further described in detail with the accompanying drawings and the specific embodiments.

Figure 1:
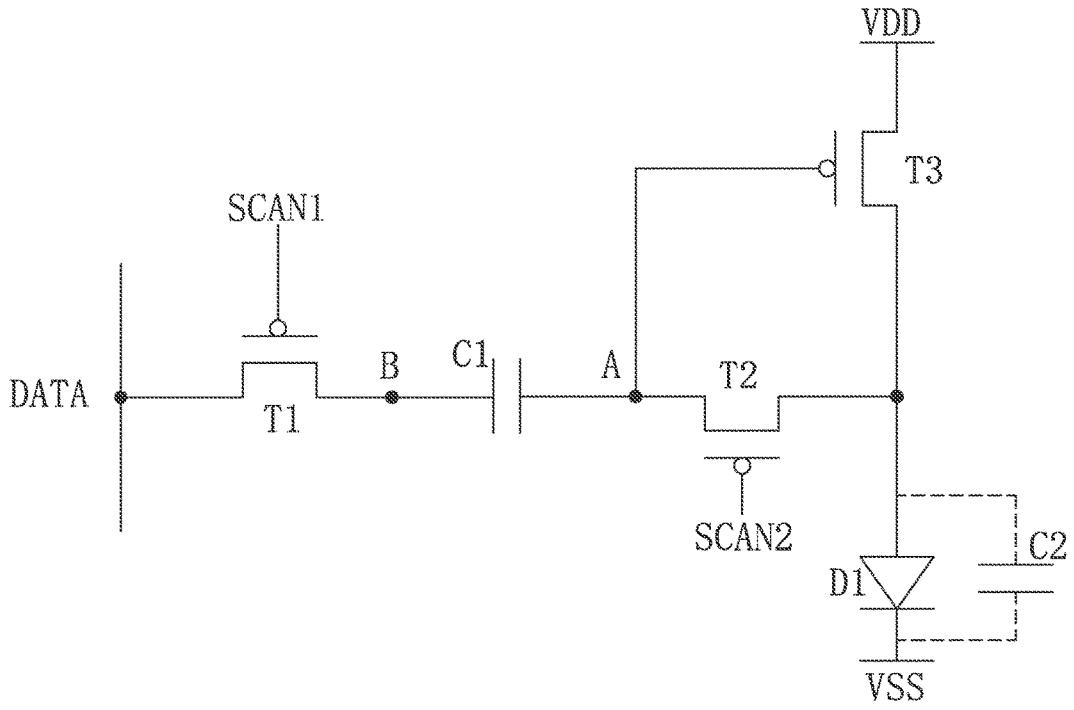
FIG. 1 is a circuit diagram of the active matrix organic light emitting diode pixel driving circuit according to the present invention.

Please refer to FIG. 1. The present invention provides an active matrix organic light emitting diode pixel driving circuit, comprising: a first thin film transistor T1, a second thin film transistor T2, a third thin film transistor T3, a capacitor C1 and an organic light emitting diode D1;

a gate of the first thin film transistor T1 receives a first scan signal SCAN1, a source receives a data signal DATA, and a drain is electrically coupled to a first end of the capacitor C1 through a second node B;

a gate of the second thin film transistor T2 receives a second scan control signal SCAN2, and a source is electrically coupled to a second end of the capacitor C1 through a first node A, and a drain is electrically coupled to an anode of the organic light emitting diode D1;

a gate of the third thin film transistor T3 is electrically coupled to the second end of the capacitor C1 through the first node A, a source receives a first power source signal VDD, and a drain is electrically coupled to the anode of the organic light emitting diode D1;

a cathode of the organic light emitting diode D1 receives a second power source signal VSS.

The first thin film transistor T1 is a scan thin film transistor. The second thin film transistor T2 is a compensation thin film transistor. The third thin film transistor T3 is a drive thin film transistor.

Specifically, a parasitic capacitance C2 is further formed in the AMOLED pixel driving circuit and the parasitic capacitance C2 is coupled with the two ends of the organic light emitting diode D1 in parallel.

Specifically, in the preferred embodiment of the present invention, the first thin film transistor T1, the second thin film transistor T2 and the third thin film transistor T3 are all P type third thin film transistors. Furthermore, the first thin film transistor T1, the second thin film transistor T2 and the third thin film transistor T3 are preferably low temperature polysilicon thin film transistors.

Figure 2:
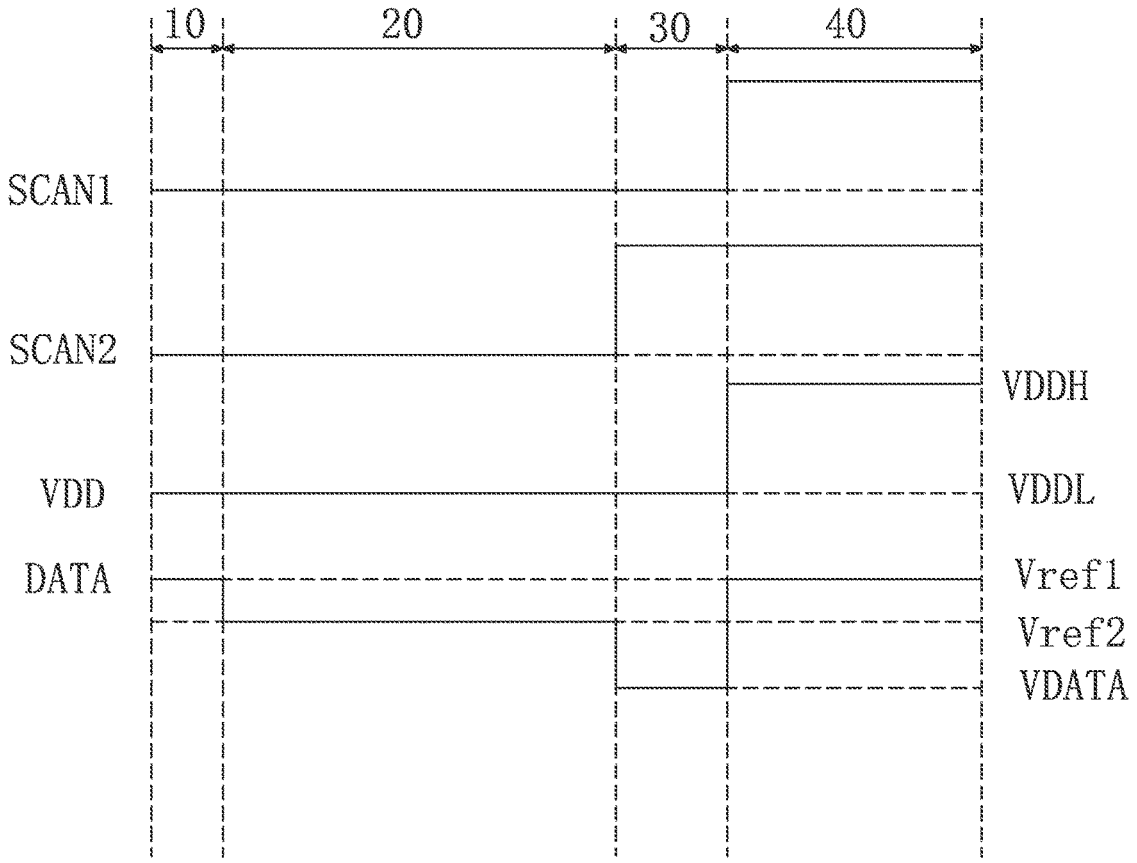
FIG. 2 is a sequence diagram of the active matrix organic light emitting diode pixel driving circuit according to the present invention.

Please refer to FIG. 2, as the AMOLED pixel driving circuit drives, the first scan signal SCAN1, the second scan signal SCAN2, the first power source signal VDD, and the data signal DATA combine with one another to successively correspond to an initialization stage 10, a threshold voltage compensation stage 20, a charging stage 30, and a light emitting stage 40.

In the initialization stage 10, the first scan signal SCAN1 is at a low voltage level, the second scan signal SCAN2 is at a low voltage level, the first power source signal VDD is a second power source voltage level VDDL, and the data signal DATA is a first reference voltage level Vref1, the first thin film transistor T1 and the second thin film transistor T2 are activated, the first node A is pulled down to a low voltage level and the second node B is charged to the first reference voltage level Vref1.

In the threshold voltage compensation stage 20, the first scan signal SCAN1 is at the low voltage level, the second scan signal SCAN2 is at the low voltage level, the first power source signal VDD is the second power source voltage level VDDL, and the data signal DATA is a second reference voltage level Vref2, the first thin film transistor T1 and the second thin film transistor T2 are activated, the voltage level of the second node B is changed to be the second reference voltage level Vref2, and the voltage level of the first node A is further pulled down due to the coupling function of the capacitor C1 so that the third thin film transistor T3 is activated, the voltage level of the first node A is changed to be a difference of the second power source voltage level VDDL and an absolute value of a threshold voltage Vth of the third thin film transistor T3, i.e., VDDL−|Vth|.

In the charging stage 30, the first scan signal SCAN1 is at the low voltage level, the second scan signal SCAN2 is at a high voltage level, the first power source signal VDD is the second power source voltage level VDDL, and the data signal is a data signal voltage level VDATA, the first thin film transistor T1 is activated, the second thin film transistor T2 is deactivated, the third thin film transistor T3 is activated, and the voltage level of the first node A is charged to be:

$$VDDL-|Vth|+(VDATA-Vref2)\times C1/(C1+C2).$$

In the light emitting stage 40, the first scan signal SCAN1 is at the high voltage level, the second scan signal SCAN2 is at the high voltage level, the first power source signal VDD is a first power source voltage level VDDH, and the data signal DATA is the first reference voltage level Vref1, the first thin film transistor T1 and the second thin film transistor T2 are deactivated, the third thin film transistor T3 is activated, and a difference of a voltage of the gate and a voltage of the source of the third thin film transistor T3 is:

$$VDDH-VDDL+(Vref2-VDATA)\times C1/(C1+C2)+|Vth|$$

Therefore, the current flowing through the organic light emitting diode D1 is: $K\times[VDDH-VDDL+(Vref2-VDATA)\times C1/(C1+C2)]^2/2$, wherein K is the characteristic constant of the third thin film transistor T3, which is only related to the third thin film transistor T3 itself, specifically: $K=\mu Cox(W/L)$, wherein p is a carrier mobility of the third thin film transistor T3, and W and L are the width and length of the channel of the third thin film transistor T3, respectively.

Thus, the current flowing through the organic light emitting diode D1 is independent of the threshold voltage of the third thin film transistor T3 to realize the compensation function, thereby effectively compensating the threshold voltage changes of the drive thin film transistor i.e., the third thin film transistor T3 to make the display brightness of the AMOLED more even and to raise the display quality.

Specifically, as shown in FIG. 2, the first reference voltage level Vref1 is larger than the second reference voltage level Vref2, the second reference voltage level Vref2 is larger than the data signal voltage level VDATA, and the first power source voltage level VDDH is larger than the second power source voltage level VDDL.

Figure 3:
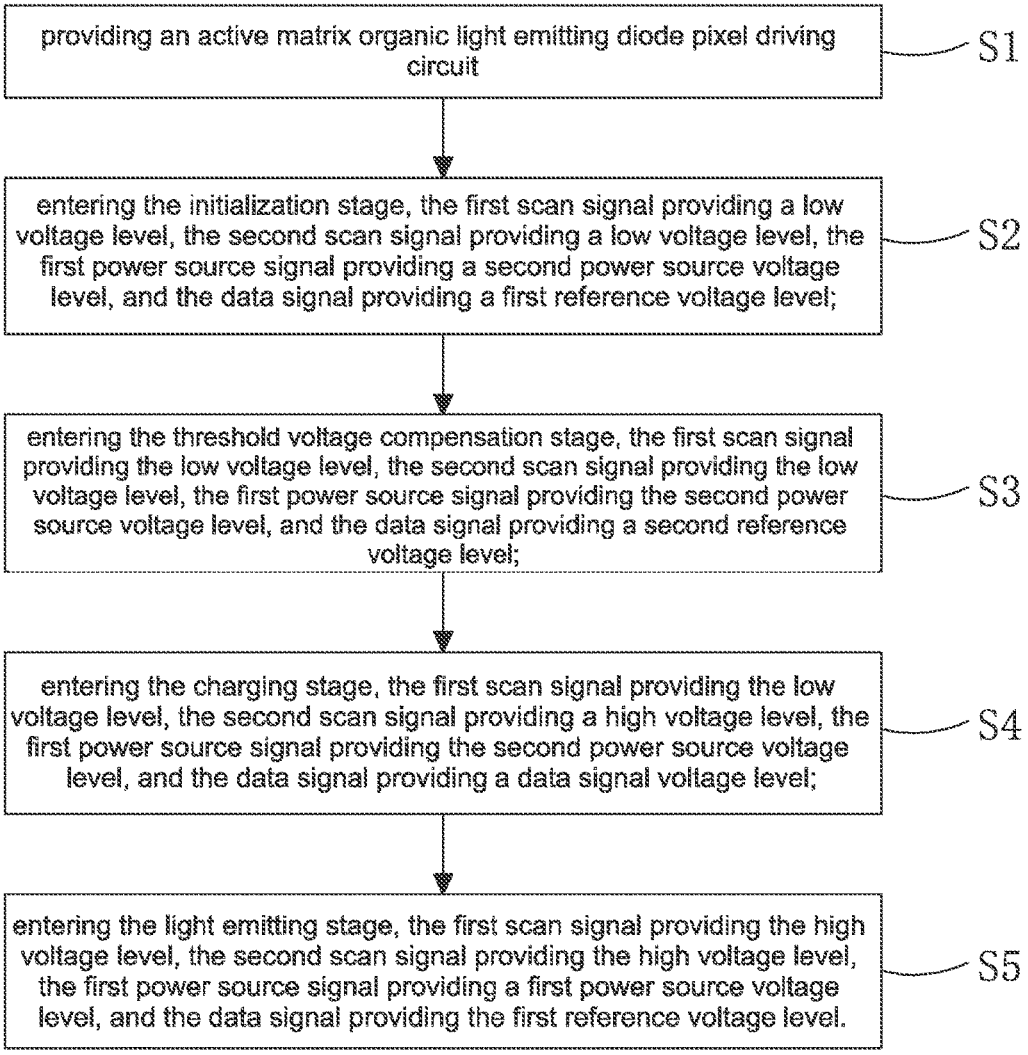
FIG. 3 is a flowchart of the active matrix organic light emitting diode pixel driving method according to the present invention.

Please refer to FIG. 3. The present invention provides an AMOLED pixel driving method, comprising steps of:

Step S1, providing an active matrix organic light emitting diode pixel driving circuit, which comprises: a first thin film transistor T1, a second thin film transistor T2, a third thin film transistor T3, a capacitor C1 and an organic light emitting diode D1; wherein a gate of the first thin film transistor T1 receives a first scan signal SCAN1, a source receives a data signal DATA, and a drain is electrically coupled to a first end of the capacitor C1 through a second node B; a gate of the second thin film transistor T2 receives a second scan control signal SCAN2, and a source is electrically coupled to a second end of the capacitor C1 through a first node A, and a drain is electrically coupled to an anode of the organic light emitting diode D1; a gate of the third thin film transistor T3 is electrically coupled to the second end of the capacitor C1 through the first node A, a source receives a first power source signal VDD, and a drain is electrically coupled to the anode of the organic light emitting diode D1; a cathode of the organic light emitting diode D1 receives a second power source signal VSS.

Specifically, the first thin film transistor T1 is a scan thin film transistor. The second thin film transistor T2 is a compensation thin film transistor. The third thin film transistor T3 is a drive thin film transistor.

Specifically, a parasitic capacitance C2 is further formed in the AMOLED pixel driving circuit and the parasitic capacitance C2 is coupled with the two ends of the organic light emitting diode D1 in parallel.

Specifically, in the preferred embodiment of the present invention, the first thin film transistor T1, the second thin film transistor T2 and the third thin film transistor T3 are all P type third thin film transistors. Furthermore, the first thin film transistor T1, the second thin film transistor T2 and the third thin film transistor T3 are preferably low temperature polysilicon thin film transistors.

Step S2, entering the initialization stage 10, the first scan signal SCAN1 providing a low voltage level, the second scan signal SCAN2 providing a low voltage level, the first power source signal VDD providing a second power source voltage level VDDL, and the data signal DATA providing a first reference voltage level Vref1.

Then, the data signal DATA is a first reference voltage level Vref1, the first thin film transistor T1 and the second thin film transistor T2 are activated, the first node A is pulled down to a low voltage level and the second node B is charged to the first reference voltage level Vref1.

Step S3, entering the threshold voltage compensation stage 20, the first scan signal SCAN1 providing the low voltage level, the second scan signal SCAN2 providing the low voltage level, the first power source signal VDD providing the second power source voltage level VDDL, and the data signal DATA providing a second reference voltage level Vref2.

Then, the first thin film transistor T1 and the second thin film transistor T2 are activated, the voltage level of the second node B is changed to be the second reference voltage level Vref2, and the voltage level of the first node A is further pulled down due to the coupling function of the capacitor C1 so that the third thin film transistor T3 is activated, the voltage level of the first node A is changed to be a difference of the second power source voltage level VDDL and an absolute value of a threshold voltage Vth of the third thin film transistor T3, i.e., VDDL−|Vth|.

Step S4, entering the charging stage 30, the first scan signal SCAN1 providing the low voltage level, the second scan signal SCAN2 providing a high voltage level, the first power source signal VDD providing the second power source voltage level VDDL, and the data signal DATA providing a data signal voltage level VDATA.

Then, the first thin film transistor T1 is activated, the second thin film transistor T2 is deactivated, the third thin film transistor T3 is activated, and the voltage level of the first node A is charged to be:

$$VDDL-|Vth|+(VDATA-Vref2)\times C1/(C1+C2).$$

Step S5, entering the light emitting stage 40, the first scan signal SCAN1 providing the high voltage level, the second scan signal SCAN2 providing the high voltage level, the first power source signal VDD providing a first power source voltage level VDDH, and the data signal DATA providing the first reference voltage level Vref1.

Then, the first thin film transistor T1 and the second thin film transistor T2 are deactivated, the third thin film transistor T3 is activated, and a difference of a voltage of the gate and a voltage of the source of the third thin film transistor T3 is:

$$VDDH-VDDL+(Vref2-VDATA)\times C1/(C1+C2)+|Vth|.$$

Therefore, the current flowing through the organic light emitting diode D1 is: $K\times[VDDH-VDDL+(Vref2-VDATA)\times C1/(C1+C2)]^2/2$, wherein K is the characteristic constant of the third thin film transistor T3, which is only related to the third thin film transistor T3 itself, specifically: $K=\mu Cox(W/L)$, wherein p is a carrier mobility of the third thin film transistor T3, and W and L are the width and length of the channel of the third thin film transistor T3, respectively.

Thus, the current flowing through the organic light emitting diode D1 is independent of the threshold voltage of the third thin film transistor T3 to realize the compensation function, thereby effectively compensating the threshold voltage changes of the drive thin film transistor i.e., the third thin film transistor T3 to make the display brightness of the AMOLED more even and to raise the display quality.

Specifically, as shown in FIG. 2, the first reference voltage level Vref1 is larger than the second reference voltage level Vref2, the second reference voltage level Vref2 is larger than the data signal voltage level VDATA, and the first power source voltage level VDDH is larger than the second power source voltage level VDDL.

In conclusion, the present invention provides an AMOLED pixel driving circuit, comprising: a first thin film transistor, a second thin film transistor, a third thin film transistor, a capacitor and an organic light emitting diode; wherein a gate of the first thin film transistor receives a first scan signal, a source receives a data signal, and a drain is electrically coupled to a first end of the capacitor through the second node; a gate of the second thin film transistor receives a second scan control signal, and a source is electrically coupled to a second end of the capacitor through the first node, and a drain is electrically coupled to an anode of the organic light emitting diode; a gate of the third thin film transistor is electrically coupled to the second end of the capacitor through the first node, a source receives a first power source signal, and a drain is electrically coupled to the anode of the organic light emitting diode; a cathode of the organic light emitting diode receives a second power source signal; the present application can effectively compensate the threshold voltage of the drive thin film transistor to ensure the uniform brightness of the organic light emitting diode for providing the AMOLED pixel drive circuit work stability to improve the display effect of the pictures. The present invention further provides an active matrix organic light emitting diode pixel driving method capable of effectively compensating the threshold voltage of the driving thin film transistor, ensuring the uniform light emitting luminance of the organic light emitting diode, improving the working stability of the AMOLED pixel driving circuit, and improving the display effect of the image.

Above are only specific embodiments of the present invention, the scope of the present invention is not limited to this, and to any persons who are skilled in the art, change or replacement which is easily derived should be covered by the protected scope of the invention. Thus, the protected scope of the invention should go by the subject claims.

What is claimed is:

1. An active matrix organic light emitting diode pixel driving circuit, comprising: a first thin film transistor, a second thin film transistor, a third thin film transistor, a capacitor and an organic light emitting diode;

wherein a gate of the first thin film transistor receives a first scan signal, a source receives a data signal, and a drain is electrically coupled to a first end of the capacitor;

a gate of the second thin film transistor receives a second scan control signal, and a source is electrically coupled to a second end of the capacitor, and a drain is electrically coupled to an anode of the organic light emitting diode;

a gate of the third thin film transistor is electrically coupled to the second end of the capacitor, a source receives a first power source signal, and a drain is electrically coupled to the anode of the organic light emitting diode;

a cathode of the organic light emitting diode receives a second power source signal;

wherein the first scan signal, the second scan signal, the first power source signal, and the data signal combine with one another to successively correspond to an initialization stage, a threshold voltage compensation stage, a charging stage, and a light emitting stage;

wherein in the initialization stage, the first scan signal is at a low voltage level, the second scan signal is at a low voltage level, the first power source signal is a second power source voltage level, and the data signal is a first reference voltage level;

in the threshold voltage compensation stage, the first scan signal is at the low voltage level, the second scan signal is at the low voltage level, the first power source signal is the second power source voltage level, and the data signal is a second reference voltage level;

in the charging stage, the first scan signal is at the low voltage level, the second scan signal is at a high voltage level, the first power source signal is the second power source voltage level, and the data signal is a data signal voltage level;

in the light emitting stage, the first scan signal is at the high voltage level, the second scan signal is at the high voltage level, the first power source signal is a first power source voltage level, and the data signal is the first reference voltage level.

2. The active matrix organic light emitting diode pixel driving circuit according to claim 1, wherein the first thin film transistor, the second thin film transistor and the third thin film transistor are all P type thin film transistors.

3. The active matrix organic light emitting diode pixel driving circuit according to claim 2, wherein the first reference voltage level is larger than the second reference voltage level, the second reference voltage level is larger than the data signal voltage level, and the first power source voltage level is larger than the second power source voltage level.

4. The active matrix organic light emitting diode pixel driving circuit according to claim 1, wherein the first thin film transistor, the second thin film transistor and the third thin film transistor are all low temperature polysilicon thin film transistors.

5. An active matrix organic light emitting diode pixel driving method, comprising steps of:

Step S1, providing an active matrix organic light emitting diode pixel driving circuit, which comprises: a first thin film transistor, a second thin film transistor, a third thin film transistor, a capacitor and an organic light emitting diode;

wherein a gate of the first thin film transistor receives a first scan signal, a source receives a data signal, and a drain is electrically coupled to a first end of the capacitor;

a gate of the second thin film transistor receives a second scan control signal, and a source is electrically coupled to a second end of the capacitor, and a drain is electrically coupled to an anode of the organic light emitting diode;

a gate of the third thin film transistor is electrically coupled to the second end of the capacitor, a source receives a first power source signal, and a drain is electrically coupled to the anode of the organic light emitting diode;

a cathode of the organic light emitting diode receives a second power source signal;

Step S2, entering an initialization stage, the first scan signal providing a low voltage level, the second scan signal providing a low voltage level, the first power source signal providing a second power source voltage level, and the data signal providing a first reference voltage level;

Step S3, entering a threshold voltage compensation stage, the first scan signal providing the low voltage level, the second scan signal providing the low voltage level, the first power source signal providing the second power source voltage level, and the data signal providing a second reference voltage level;

Step S4, entering a charging stage, the first scan signal providing the low voltage level, the second scan signal providing a high voltage level, the first power source signal providing the second power source voltage level, and the data signal providing a data signal voltage level;

Step S5, entering a light emitting stage, the first scan signal providing the high voltage level, the second scan signal providing the high voltage level, the first power source signal providing a first power source voltage level, and the data signal providing the first reference voltage level.

6. The active matrix organic light emitting diode pixel driving method according to claim 5, wherein the first thin film transistor, the second thin film transistor and the third thin film transistor are all P type thin film transistors.

7. The active matrix organic light emitting diode pixel driving method according to claim 6, wherein the first reference voltage level is larger than the second reference voltage level, the second reference voltage level is larger than the data signal voltage level, and the first power source voltage level is larger than the second power source voltage level.

8. The active matrix organic light emitting diode pixel driving method according to claim 5, wherein the first thin film transistor, the second thin film transistor and the third thin film transistor are all low temperature polysilicon thin film transistors.

9. An active matrix organic light emitting diode pixel driving circuit, comprising: a first thin film transistor, a second thin film transistor, a third thin film transistor, a capacitor and an organic light emitting diode;

wherein a gate of the first thin film transistor receives a first scan signal, a source receives a data signal, and a drain is electrically coupled to a first end of the capacitor;

a gate of the second thin film transistor receives a second scan control signal, and a source is electrically coupled to a second end of the capacitor, and a drain is electrically coupled to an anode of the organic light emitting diode;

a gate of the third thin film transistor is electrically coupled to the second end of the capacitor, a source receives a first power source signal, and a drain is electrically coupled to the anode of the organic light emitting diode;

a cathode of the organic light emitting diode receives a second power source signal;

wherein the first scan signal, the second scan signal, the first power source signal, and the data signal combine with one another to successively correspond to an initialization stage, a threshold voltage compensation stage, a charging stage, and a light emitting stage;

wherein in the initialization stage, the first scan signal is at a low voltage level, the second scan signal is at a low voltage level, the first power source signal is a second power source voltage level, and the data signal is a first reference voltage level;

in the threshold voltage compensation stage, the first scan signal is at the low voltage level, the second scan signal is at the low voltage level, the first power source signal is the second power source voltage level, and the data signal is a second reference voltage level;

in the charging stage, the first scan signal is at the low voltage level, the second scan signal is at a high voltage level, the first power source signal is the second power source voltage level, and the data signal is a data signal voltage level;

in the light emitting stage, the first scan signal is at the high voltage level, the second scan signal is at the high voltage level, the first power source signal is a first power source voltage level, and the data signal is the first reference voltage level;

wherein the first reference voltage level is larger than the second reference voltage level, the second reference voltage level is larger than the data signal voltage level, and the first power source voltage level is larger than the second power source voltage level;

wherein the first thin film transistor, the second thin film transistor and the third thin film transistor are all low temperature polysilicon thin film transistors.

* * * * *